United States Patent [19]

Wasson et al.

[11] 4,362,532

[45] Dec. 7, 1982

[54] PRODUCTION OF BLAST FURNACE COKE VIA NOVEL BRIQUETTING SYSTEM

[75] Inventors: George E. Wasson, Eighty Four; Frank W. Theodore, Pittsburgh, both of Pa.

[73] Assignee: Conoco Inc., Stamford, Conn.

[21] Appl. No.: 291,752

[22] Filed: Aug. 11, 1981

[51] Int. Cl.[3] ..... C10L 5/16

[52] U.S. Cl. ..... 44/23; 75/42

[58] Field of Search ..... 44/23, 10 C, 1 F; 201/16; 75/42

[56] References Cited

U.S. PATENT DOCUMENTS

| | | | |
|---|---|---|---|
| 3,073,751 | 1/1963 | Gorin et al. | 44/23 |
| 3,800,428 | 4/1974 | Ashland et al. | 34/20 |
| 3,856,481 | 12/1974 | Mikhailovich et al. | 44/10 H |
| 3,926,576 | 12/1975 | Schmalfeld et al. | 44/10 H |
| 3,969,088 | 7/1976 | Mansfield et al. | 44/10 C |
| 3,980,447 | 9/1976 | Franke et al. | 44/10 D |
| 3,996,108 | 12/1976 | Joseph | 201/6 |
| 4,202,734 | 5/1980 | Greenbaum | 44/10 C |
| 4,290,780 | 9/1981 | Dudt | 44/10 C |

OTHER PUBLICATIONS

Elliott, Martin A., *Chemistry of Coal Utilization,* Second Supplementary vol., 1981, pp. 633–638.

*Primary Examiner*—Charles F. Warren
*Assistant Examiner*—Margaret B. Medley
*Attorney, Agent, or Firm*—Dale Lovercheck; William A. Mikesell, Jr.

[57] ABSTRACT

A method of making high strength coke briquettes suitable for use as blast furnace coke comprising, (a) providing coal, (b) heating the coal at a temperature at or above the softening point of the coal to form partially carbonized char, (c) cooling the partially carbonized char below the softening point of the coal, (d) mixing the cooled partially carbonized char and tar to form a mixture of tar and partially carbonized char, (e) briquetting the mixture of tar and partially carbonized char to form briquettes of tar and partially carbonized char, (f) calcinating the briquettes to form high strength briquettes.

11 Claims, 1 Drawing Figure

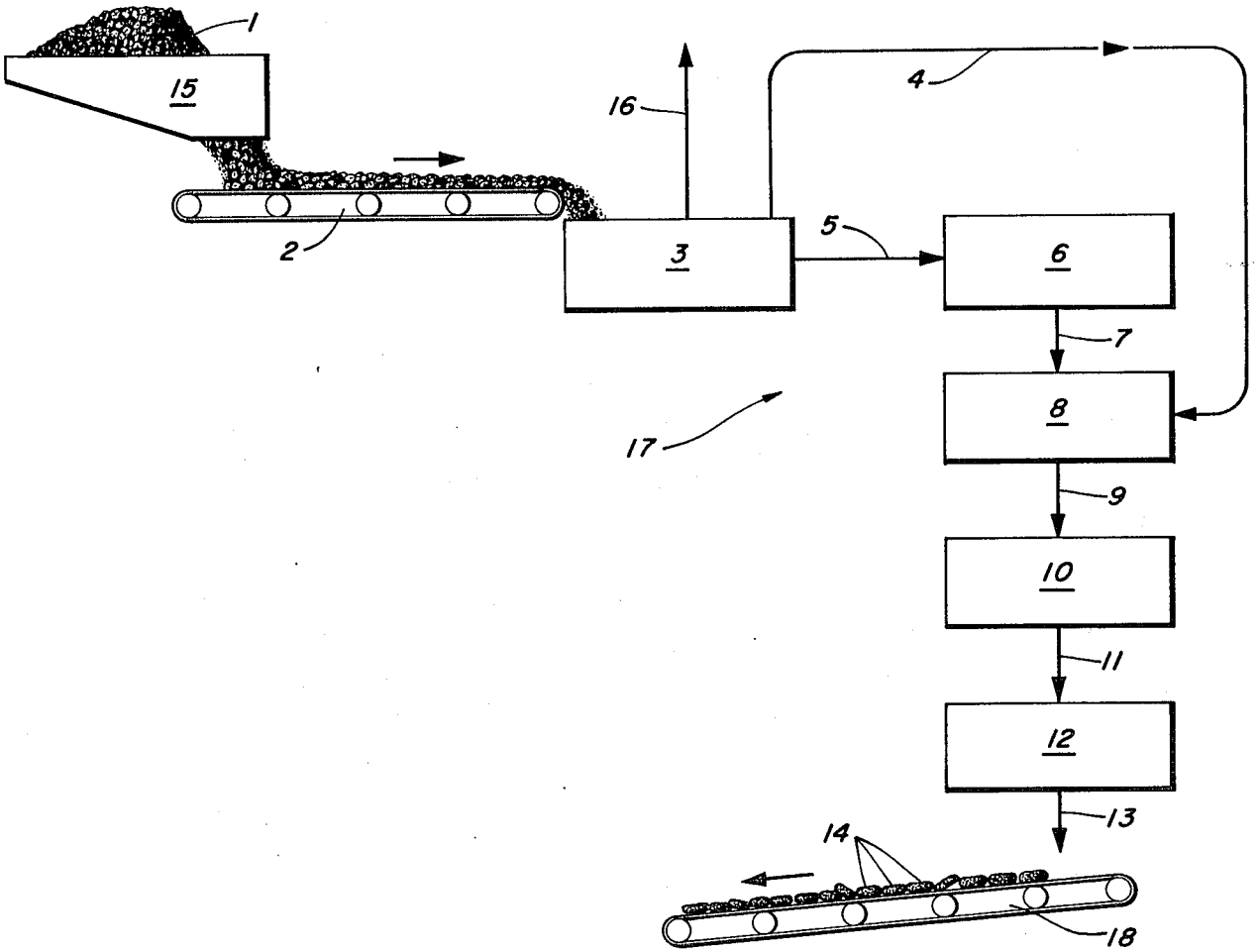
1
2
3
4
5
6
7
8
9
10
11
12
13
14
15
16
17
18

PRODUCTION OF BLAST FURNACE COKE VIA NOVEL BRIQUETTING SYSTEM

BACKGROUND OF THE INVENTION

Schmalfeld et al in U.S. Pat. No. 3,926,576 discloses briquettes having improved crushing strength which are made from hot coke containing mixtures at temperatures between 350° to 550° C. These briquettes are made by admixing tar pitch with hot coke and then pressure forming the briquettes, for example on a double roll press. In Example 3, Schmalfeld et al disclosed that the strength of the cooled briquettes was increased to 161 kilograms per square centrimeter.

Mansfield et al in U.S. Pat. No. 3,969,088 discloses raw coal being charred in pre and post treatment carbonizers, then pulverized, mixed with pitch, briquetted, re-circulated through the pre and post treatment carbonizers with succeeding green coal, cooled, and finely separated from the as yet unbriquetted char.

Mikhailovich Grechanichenko et al in U.S. Pat. No. 3,856,481 disclosed a method of making plastic coal briquettes wherein initial coal is heated up to a softening temperature and subsequently cured under approximately isothermal conditions. Pressure forming is then effective in two stages. During the first stage, a coal strip of which the thickness is not less than the required thickness of a final product, i.e. of a briquette is pressure formed while during the second pressure forming stage plastic coal briquettes are produced from this strip.

Elliott, *Chemistry of Coal Utilization,* Second Supplementary Volume, 1981, pages 633–638, discloses a coking process wherein brown coal is dried, low temperature carbonized, cooled, comminuted, mixed with tar and additives briquetted and coked. Brown coal is a non-caking coal which do not have a softening point. The coke briquettes of Elliott is not a blast furnace quality high strength product.

SUMMARY OF THE INVENTION

A method of making high strength coke briquettes suitable for use as blast furnace coke comprising, (a) providing coal, (b) heating the coal at a temperature at or above the softening point of the coal to form partially carbonized char, (c) cooling the partially carbonized char to below the softening point of the coal, (d) mixing the cooled partially carbonized char and tar to form a mixture of tar and partially carbonized char, (e) briquetting the mixture of tar and partially carbonized char to form briquettes of tar and partially carbonized char, (f) calcinating the briquettes to form high strength briquettes.

In the method of the present invention it is preferred that the cooling of the partially carbonized char be to a temperature of ambient to 240° F.

DETAILED DESCRIPTION OF THE INVENTION

In the making of coke briquettes in the past there have been problems in briquetting. In hot briquetting, the coke material has adhesive properties which cause the feed materials to adhere to the equipment transferring the feeds to the briquetter. When cold carbonaceous material is briquetted, the briquette product is of low strength. The present invention provides an improved coke briquetter feed material with improved handling characteristics and a method which provides an improved blast furnace quality coke briquette product.

The improved strength in the briquette product of the present invention is due to the briquetting of partially carbonized coal. The coal to be briquetted, which is preferably a caking coal, may be ground coal which is 80 percent passing an ⅛ inch screen.

In the process of the present invention the coal, which may be Eastern coal, is preferably ground, and then partially carbonized by heating. In the partial carbonization by heating of the ground coal, coal is heated to a temperature at or above the softening point of the coal and below the temperature at which it loses its caking property, and preferably to temperatures within the range of 750° to 850° F. The softening point of the coal is defined by ASTM D-2639-71.

While the partially carbonized coal is at 750° to 850° F. (for example for 5 to 30 minutes), gases and tars are given off from the coal. These gases and tars are separated. The gas constitutes a fuel gas product and portions of the tar may be later recombined with the partially carbonized coal as a binder for briquetting. After heating the coal to temperatures in the range 750° to 850° F., the partially carbonized char is then cooled below the softening point of the coal. The cooled char may then be mixed with tar, and then briquetted. Because the briquetting is done at temperatures below the softening point of the coal, the problems of the prior art of sticky coal adhering to the briquetter feed equipment are avoided. The temperature to which the partially carbonized char is cooled may be any temperature below the softening point of the coal. Preferred temperatures are temperatures between 0° F. and 750° F. Most preferably the char is cooled to between ambient temperature to 240° F. Ambient temperature may be room temperature, i.e. 70° F. or for example in the summer it may be 90° F. or in the winter it may be 20° F.

The cooled char which has been mixed with tar and then briquetted is then calcinated at a temperature preferably between 1500° and 1700° F. The calcinated briquettes constitute a high strength coke suitable for use as blast furnace coke.

In a preferred method of carrying out the invention, the partially carbonized coke which has been cooled is then ground before being mixed with tar.

With more particular reference to the drawing a high strength coke briquetting system is indicated generally at 17. The coal 1 may be ground coal which is 80 percent less than ⅛ inch. The coal 1 in storage container 15 may be conveyed by conveyor mechanism 2 to partial carbonizer 3. Alternatively, the ground coal may be fluidized and conveyed through a duct by carrier gas to the partial carbonizer. The partial carbonizer 3 heats the coal to temperatures between 750° to 850° F. to form partially carbonized char which is conveyed to the cooler 6. The partial carbonizer 3 may alternatively be a two-stage heating system wherein the ground coal is first heated to about 600° F. in a first stage and then heated to temperatures between 750° to 850° F. in a second heating stage. In a preferred embodiment of the invention, oxygen is admitted to the partial carbonizer 3 whereby the coal is partially oxidized in the carbonizer. Also formed from the heating of the coal in the partial carbonizer 3 are gas and tar. The mixture of gas and tar is separated into a gas stream and a tar stream by a gas-solids separater not shown in the figure. The gas which is taken off in line 16 may be used as a heating fuel and a portion of the tar which is taken off in line 4 may be used for recombination with the partially carbonized char as shown in the figure. From the cooler 6 the cooled char which is partially carbonized is conveyed in line 7 to the mixer 8. Prior to reaching the mixer 8 the cooled partially carbonized char may be ground. In the mixer 8 the cooled partially carbonized char is mixed with tar to form a mixture of cooled partially carbonized char and tar which is carried in line 9 to the briquetter 10. Briquettes of the mixture of cooled partially carbonized char and tar are carried in line 11 to the calcinator 12 where they are calcinated between 1500° F. and 1700° F. and preferably at about 1600° F. to form high strength coke briquettes 14 which are suitable for use as blast furnace coke. The high strength coke briquettes are carried by line 13 to conveyor 18 which conveys them to a point of use or storage.

Table I shows an example of briquettes produced in accordance with the present invention. In the example an Eastern coal, namely Pittsburgh Seam coal, is ground to a size which is 80 percent less than $\frac{1}{8}$ inch. The ground coal is heated to a partial carbonization temperature shown in degrees Fahrenheit, then cooled to a temperature between 180° and 200° F., ground, then mixed with tar in the weight percent amount shown (the remainder being ground partially carbonized char) and briquetted prior to calcinating at about 1650° F. The coke hardness is ASTM tumbler at 1400 revolutions as the percentage of briquettes larger than $\frac{1}{4}$ inch in cross section.

With regard to the example in Table I, the coke product formed is very acceptable in respect both to its coke hardness and with regard to the percent of briquettes fusing together during calcination.

It should be noted that the coke product of the example may be well suited for other purposes. Furthermore, it should be appreciated by those skilled in the art that by using other coals that acceptable blast furnace coke may be obtained at partial carbonization temperatures of about 750° to 850° F. Many variations of the proportions of tar to coke in weight percentages will be apparent to those of ordinary skill in the art and are considered to be within the scope of this invention.

TABLE I

| | Example |
|---|---|
| Carbonization Temp., °F. | 800 |
| Tar Employed, wt. % | 10 |
| Coke Hardness | 66.6 |
| % Briquettes Fusing Together During Calcination | 1.7 |

While the invention has been described above with respect to certain of its preferred embodiments it is respectfully pointed out that many variations and modifications are possible within the scope of the present invention and it is anticipated that many such variations and modifications may appear obvious or desirable to those skilled in the art based upon a review of the foregoing description of preferred embodiments.

Having thus described the invention, we claim:

1. A method of making high strength coke briquettes comprising the sequence of steps as follows:

(a) providing coal, (b) heating said coal to partial carbonization temperatures at or above the softening point of said coal and below the temperature at which said coal loses a substantial portion of its caking property, to form partially carbonized char, (c) cooling said partially carbonized char to below the softening point of the coal, (d) mixing said cooled partially carbonized char and tar to form a mixture of tar and partially carbonized char, (e) briquetting said mixture of tar and partially carbonized char at a temperature below the softening point of coal to form briquettes of tar and partially carbonized char, (f) calcinating said briquettes to form high strength briquettes.

2. The method of claim 1 further comprising removing tar from said coal during the heating of said coal and said heating is to temperatures between 750° and 850° F.

3. The method of claim 2 further comprising removing gas from said coal during said heating of said coal and said heating is to temperatures between 750° and 850° F.

4. The method of claim 1 wherein said heating is to temperatures between 750° and 850° F. and said cooling of said partially carbonized char is to a temperature less than 750° F.

5. The method of claim 1 wherein said cooling of said partially carbonized char is to a range of 240° to 40° F.

6. The method of claim 1 wherein said calcinating is at a temperature between 1500° to 1700° F.

7. The method of claim 1 wherein said heating further comprises oxidizing said coal.

8. The method of claim 1 wherein said coal provided in step (a) is ground coal.

9. The method of claim 1 further comprising grinding said partially carbonized char.

10. The method of claim 1 wherein said coal is a caking coal.

11. The method of claim 10 wherein said high strength coke briquettes are of blast furnace coke strength.

* * * * *